US008545043B2

(12) United States Patent
Yeh

(10) Patent No.: US 8,545,043 B2
(45) Date of Patent: Oct. 1, 2013

(54) ILLUMINATION DEVICE FOR PROVIDING SYNCHRONOUS FORWARD AND BACKWARD LIGHTING

(75) Inventor: Hsueh-Chu Yeh, Tainan (TW)

(73) Assignee: Day Sun Industrial Corp., Tainan (TW)

( * ) Notice: Subject to any disclaimer, the term of this patent is extended or adjusted under 35 U.S.C. 154(b) by 193 days.

(21) Appl. No.: 13/293,205

(22) Filed: Nov. 10, 2011

(65) Prior Publication Data

US 2013/0121003 A1 May 16, 2013

(51) Int. Cl.
*F21L 4/04* (2006.01)

(52) U.S. Cl.
USPC ..... 362/202; 362/200; 362/297

(58) Field of Classification Search
USPC ..... 362/202, 200, 297, 298
See application file for complete search history.

(56) References Cited

U.S. PATENT DOCUMENTS

| | | | | |
|---|---|---|---|---|
| 7,819,549 | B2 * | 10/2010 | Narendran et al. | 362/228 |
| 8,469,546 | B2 * | 6/2013 | Pedersen | 362/249.03 |
| 2007/0097676 | A1 * | 5/2007 | Chien | 362/202 |

* cited by examiner

*Primary Examiner* — Evan Dzierzynski
(74) *Attorney, Agent, or Firm* — Alan Kamrath; Kamrath IP Lawfirm, P.A.

(57) ABSTRACT

An illumination device for providing synchronous forward and backward lighting is disclosed. The illumination device includes a light housing of a predetermined shape and an illumination light source provided in the light housing. Also provided in the light housing is a reflector having a front section and a rear section, each of which sections forms a flared reflective area. Light emitted by the illumination light source in the light housing is reflected by the reflective areas of the front and rear sections of the reflector and hence directed both forward and backward, so as for the illumination device to provide wide-range lighting when in use.

6 Claims, 4 Drawing Sheets

ILLUMINATION DEVICE FOR PROVIDING SYNCHRONOUS FORWARD AND BACKWARD LIGHTING

BACKGROUND OF THE INVENTION

1. Technical Field

The present invention relates to an illumination device for providing synchronous forward and backward lighting. More particularly, the present invention relates to an illumination device configured for projecting light in predetermined generally opposite directions (e.g., upward and downward, or forward and laterally) so as to provide wide-range lighting, wherein the light projected in the secondary direction serves not only esthetic purposes but also as an alert when it is too dark for the user using the illumination device to be seen by others.

2. Description of Related Art

Nowadays, commercially available illumination devices such as wall lamps, small night lamps, and desk lamps typically include a light housing of a predetermined shape and an illumination light source set in the light housing. The illumination light source in the light housing projects light through an illumination area at one end of the light housing so as to produce the expected lighting effect.

One notable example of such illumination devices is the flashlight, which essentially includes a housing, an illumination unit, and a cap internally formed with a reflective area. The illumination unit includes a preset illumination light, a battery pack for supplying electric power to the illumination light, and electrically conductive plates connected with the battery pack, all of which components are received in the housing. In addition, a switch for turning on and off the illumination unit is provided at a predetermined position on the housing. Once the illumination unit is received in the housing, and the cap is screwed onto the front end thereof, the flashlight is fully assembled and ready for use.

However, the aforesaid conventional illumination devices can only provide lighting at one end but cannot emit light in multiple directions. As the reflective area in such an illumination device is generally flared forward, light is projected in one direction (i.e., forward) only. This can raise safety issues where it is so dark that the user using the illumination device cannot be seen by others. It is highly desirable that an illumination device can also provide lateral lighting as an alert to those nearby.

BRIEF SUMMARY OF THE INVENTION

The present invention provides an improvement over the existing illumination devices that are designed for illumination purposes, wherein the improvement consists in overcoming the afore-mentioned drawbacks in use. More specifically, the improvement consists in equipping an illumination device with a reflector which is located in a light housing and whose front and rear sections form flared reflective areas respectively. Thanks to the reflective areas of the front and rear sections of the reflector, light emitted by an illumination light source in the light housing is directed both forward and backward, so as for the illumination device to provide lighting over a wider range than its prior art counterparts.

The first objective of the present invention is to provide an illumination device including a light housing of a predetermined shape and an illumination light source installed in the light housing. Also installed in the light housing is a reflector having a front section and a rear section, each of which sections forms a flared reflective area. The reflective areas of the front and rear sections of the reflector can reflect light emitted by the illumination light source so that the light is directed both forward and backward and hence covers a wider range than that which is attainable by the conventional devices.

The second objective of the present invention is to provide an illumination device including a light housing, a main body, a reflector, and a cap fitted therein with a transparent cover. The light housing is composed of an inner housing member and an outer housing member. The inner housing member is formed of a light-permeable material and has a front end extended with an externally threaded section. In addition, an O-ring is mounted around this externally threaded section, and at least one hollow area is formed on the periphery of the outer housing member. The main body is configured for receiving a battery pack therein and has a front end connected with the reflector. The reflector has a front section and a rear section, each of which sections forms a flared reflective area. To assemble the illumination device, the main body, whose front end is connected with the reflector in advance, is inserted into the inner housing member. Then, the inner housing member is connected with the outer housing member. After that, the cap is screwed onto the externally threaded section extending from the front end of the inner housing member. When the assembled illumination device is powered on, light emitted by the illumination light source at the front end of the main body is reflected by the reflective areas of the front and rear sections of the reflector and is therefore directed both forward and backward. The forward directed light passes through the cap at the front end of the illumination device, while the backward directed light passes through the light-permeable inner housing member and the at least one hollow area on the periphery of the outer housing member. Thus, the illumination device, once turned on, synchronously provides forward lighting and lateral lighting, the latter of which serves not only esthetic purposes but also as an alert when it is too dark for the user using the illumination device to be seen by others.

The third objective of the present invention is to provide the foregoing illumination device, wherein the outer periphery of the inner housing member is provided with at least one groove, and the outer housing member is provided with at least one pair of spaced apart ribs corresponding in position to the at least one groove. The at least one pair of ribs can be tightly fitted in the at least one groove to limit the relative positions of the inner and outer housing members.

The fourth objective of the present invention is to provide the foregoing illumination device, wherein the rear end of the inner housing member is formed with at least one recess, and the outer housing member is protrudingly provided with at least one engaging portion corresponding in position to the at least one recess. The at least one engaging portion can be engaged with the at least one recess to assist in limiting the relative positions of the inner and outer housing members.

The fifth objective of the present invention is to provide the foregoing illumination device, wherein a rear-end periphery of the reflector is extended with two hooks to be respectively engaged in openings formed at corresponding positions of the main body, and a pressing portion is circumferentially provided adjacent to, on the inner side of, and spaced from each hook of the reflector and is engageable with a corresponding peripheral portion of the main body. The hooks and the pressing portions of the reflector and the openings and the peripheral portions of the main body serve to limit the relative positions of the reflector and the main body.

The sixth objective of the present invention is to provide the foregoing illumination device, wherein the rear end of the inner housing member is formed with a hole through which a pushbutton portion at the rear end of the main body can extend during assembly.

BRIEF DESCRIPTION OF THE SEVERAL VIEWS OF THE DRAWINGS

The structure as well as a preferred mode of use, further objectives, and advantages of the present invention will be best understood by referring to the following detailed description of some illustrative embodiments in conjunction with the accompanying drawings, in which.

DETAILED DESCRIPTION OF THE INVENTION

Figure 1:
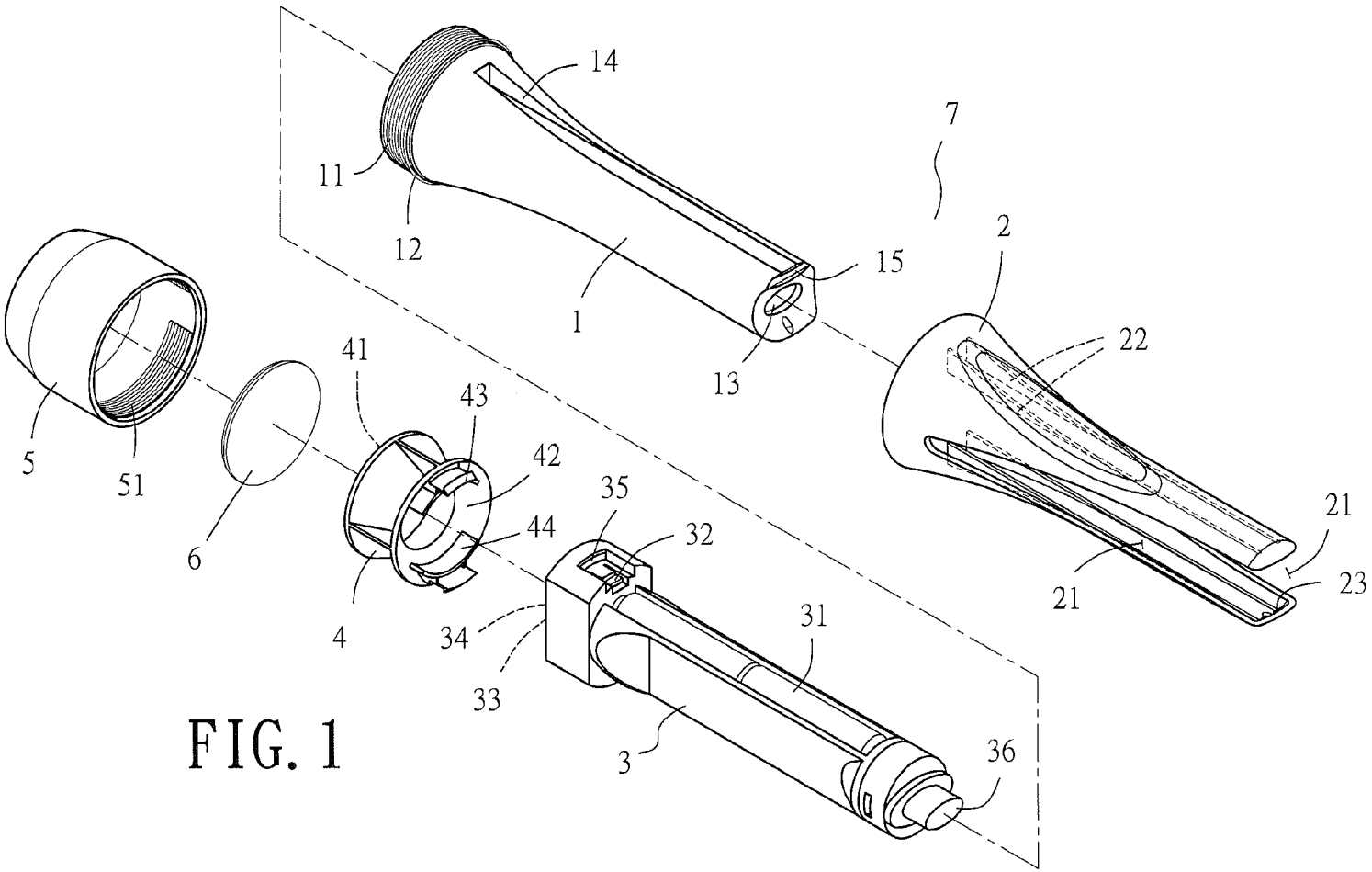
FIG. 1 is an exploded perspective view of an illumination device according to the present invention.

The present invention discloses an illumination device for providing synchronous forward and backward lighting. In one embodiment of the present invention as shown in FIG. 1, the illumination device is formed as a flashlight and essentially includes an inner housing member 1, an outer housing member 2, a main body 3, a reflector 4, and a cap 5 fitted therein with a transparent cover 6.

The inner housing member 1 is a hollow and generally cylindrical housing member formed of a light-permeable plastic material. The front end of the inner housing member 1 is extended with an externally threaded section 11 around which an O-ring 12 is mounted. The rear end of the inner housing member 1 is formed with a hole 13. Besides, the outer periphery of the inner housing member 1 is provided with at least one groove 14, and the rear end of the inner housing member 1 is further formed with at least one recess 15 (see FIGS. 1 and 3).

The outer housing member 2 is a light-impermeable housing member corresponding in shape to the outer periphery of the inner housing member 1. The outer housing member 2 is peripherally provided with at least one hollow area 21. The inner periphery of the outer housing member 2 is formed with at least one pair of spaced apart ribs 22 (see FIG. 1) that correspond in position to the at least one groove 14 of the inner housing member 1. In addition, the rear end of the outer housing member 2 is protrudingly provided with at least on engaging portion 23 (see FIGS. 1 and 3).

The main body 3 is an illumination unit receivable in the inner housing member 1. The middle section of the main body 3 defines a receiving area for receiving a plurality of batteries 31. The front end of the main body 3 is connected with a base plate 32 (see FIGS. 1 and 3), a plate 33 adjacent to the base plate 32, and an illumination light source provided on the plate 33, wherein the illumination light source in this embodiment is a light-emitting diode (LED) 34. The front end of the main body 3 that is connected with the LED 34 is formed with openings 35. The rear end of the main body 3 is provided with a pushbutton portion 36 for turning on and off the illumination light source.

The reflector 4 is a light-reflecting component to be connected to the front end of the main body 3. The front section and the rear section of the reflector 4 form a flared reflective area 41 and a flared reflective area 42 respectively (see FIGS. 1 and 3). The reflector 4 has a rear-end periphery extended with two hooks 43. Meanwhile, a pressing portion 44 is circumferentially provided adjacent to, on the inner side of, and spaced from each hook 43.

The cap 5 is a cover component corresponding in shape to the externally threaded section 11 at the front end of the inner housing member 1. The cap 5 is fitted therein with a transparent cover 6 (see FIGS. 1 and 3) and has an inner periphery whose rear section forms a threaded section 51.

Figure 2:
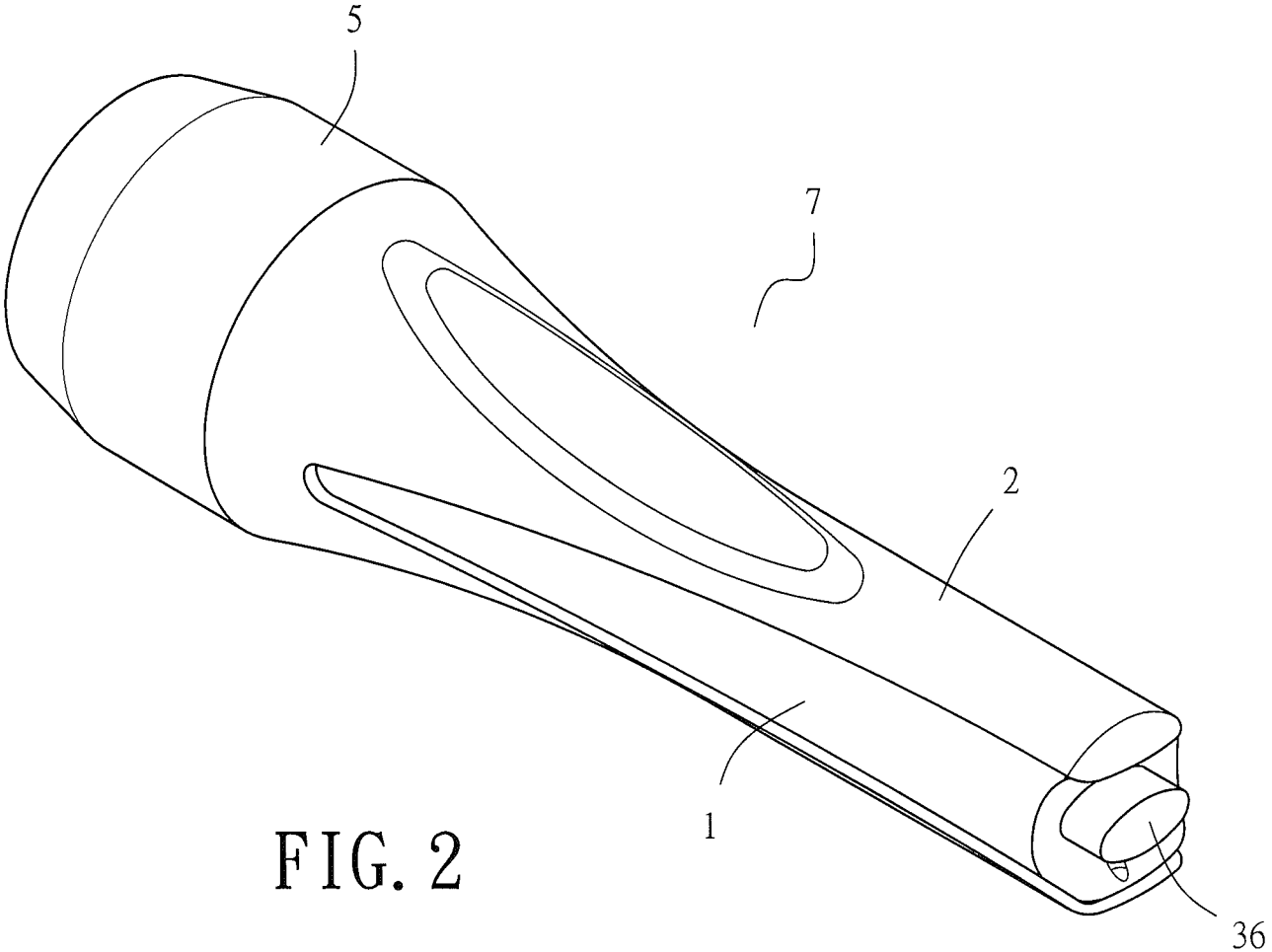
FIG. 2 is an assembled perspective of the illumination device depicted in FIG. 1.
Figure 3:
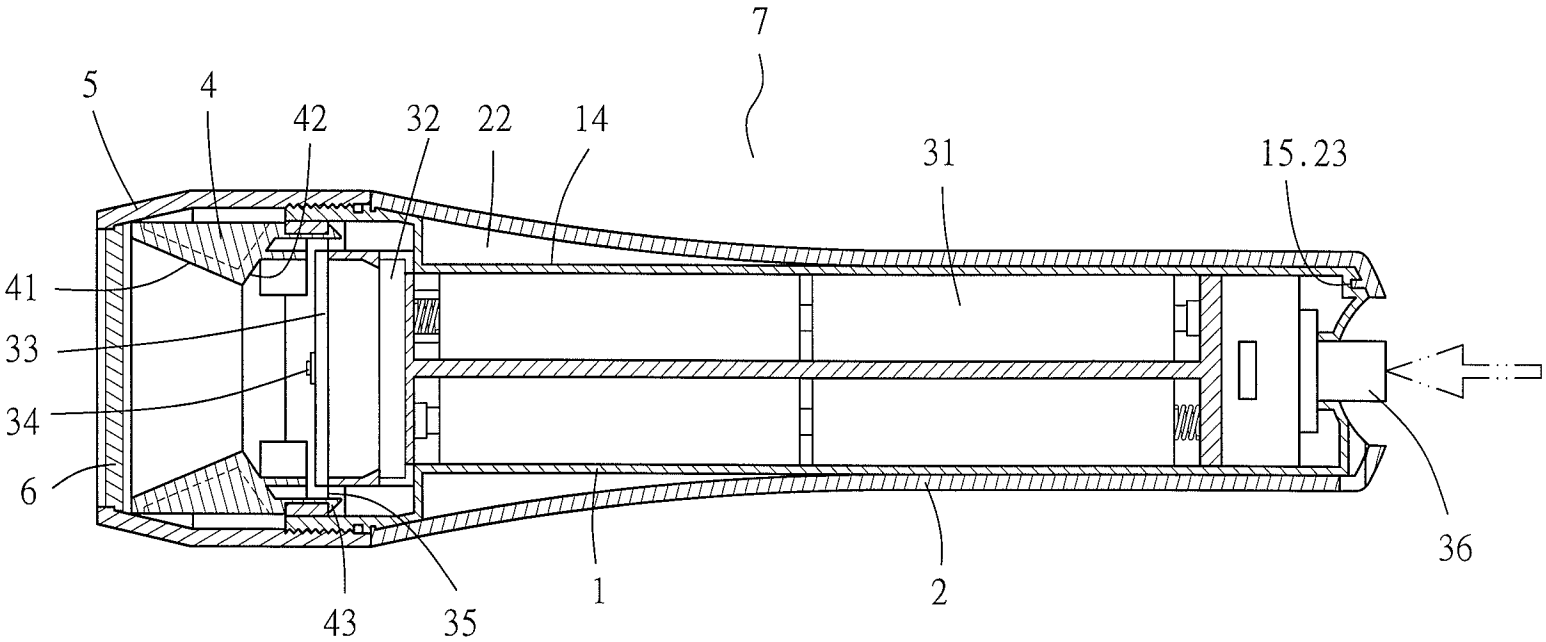
FIG. 3 is a sectional view of the illumination device depicted in FIG. 1.

The inner housing member 1, the outer housing member 2, the main body 3, the reflector 4, and the cap 5 fitted therein with the transparent cover 6 are put together in the following manner, as shown in FIGS. 1 and 3. The first step of the assembly process is to bring the two hooks 43 extending rearward from the reflector 4 into engagement with the corresponding openings 35 of the main body 3 respectively. At the same time, the pressing portions 44 adjacent to and spaced from the hooks 43 are pressed against the corresponding peripheral portions of the main body 3 respectively. Thus, the reflector 4 and the main body 3 are limited in position relative to each other. The second step is to insert the main body 3, which is now connected with the reflector 4 at the front end, into the inner housing member 1. As a result, the pushbutton portion 36 at the rear end of the main body 3 juts out of the opening 13 of the inner housing member 1. Then, the inner housing member 1 is received in the outer housing member 2, so as for the pairs of spaced apart ribs 22 on the outer housing member 2 to fit respectively and tightly in the corresponding grooves 14 on the outer periphery of the inner housing member 1, and for the engaging portion 23 at the rear end of the outer housing member 2 to engage with the recess 15 of the inner housing member 1. Consequently, the relative positions of the inner and outer housing members 1, 2 are strictly limited. In the third step, the cap 5, which is fitted therein with the transparent cover 6, is screwed onto the externally threaded section 11 at the front end of the inner housing member 1 to complete the illumination device 7 (see FIGS. 2 and 3).

Figure 4:
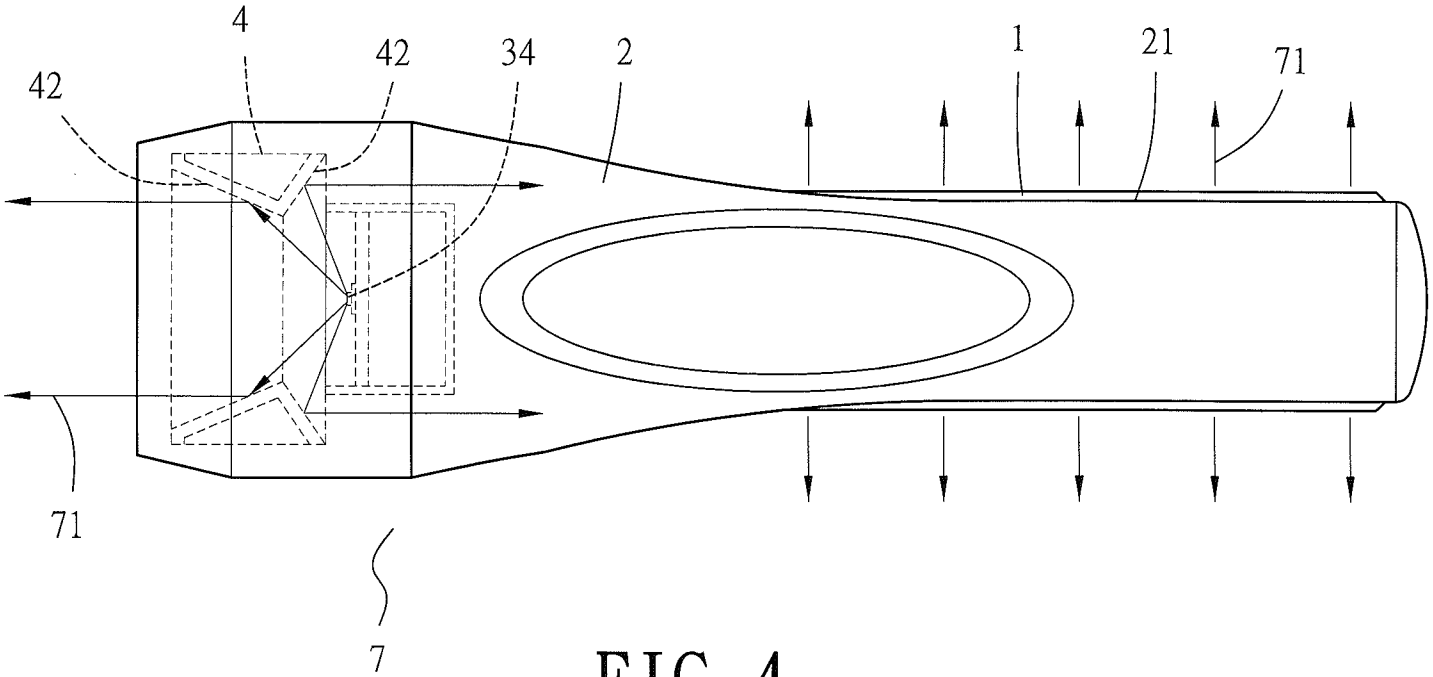
FIG. 4 shows forward and lateral lighting by the illumination device depicted in FIG. 1.

Referring to FIG. 4, once the assembled illumination device 7 is turned on for illumination, the illumination light source (i.e., the LED 34) at the front end of the main body 3 emits light. The light is reflected by the reflective areas 41, 42 of the front and rear sections of the reflector 4 and is therefore directed both forward and backward. The forward directed light 71 passes through the cap 5 at the front end of the illumination device 7, while the backward directed light 71 passes sequentially through the light-permeable inner housing member 1 and the hollow areas 21 on the periphery of the outer housing member 2. Hence, the illumination device 7, when powered on, provides wide-range lighting, or more specifically, synchronous forward and lateral lighting, wherein the lateral lighting not only is visually pleasant but also serves as an alert in cases where it is too dark for the user using the illumination device 7 to be seen by others. Besides, the illumination light source (i.e., the LED 34) can be switched between different lighting modes (e.g., a low light mode, a high light mode, a flashing mode, and an OFF mode) by pushing the pushbutton portion 36.

In another embodiment of the present invention, the disclosed illumination device for providing synchronous forward and backward lighting is implemented as a wall lamp, a small night lamp, or a desk lamp. The illumination device includes a light housing of a predetermined shape and an illumination light source located in the light housing. A reflector having a front section and a rear section is provided in the light housing, wherein each of the front and rear sections forms a flared reflective area. Light emitted by the illumination light source in the light housing is reflected by the reflective areas of the front and rear sections of the reflector and hence directed both forward and backward (or upward and downward), so as for the illumination device to provide wide-range lighting.

What is claimed is:

1. An illumination device for providing synchronous forward and backward lighting, comprising a light housing of a predetermined shape and an illumination light source provided in the light housing, the illumination device being characterized in that:

a reflector having a front section and a rear section is provided in the light housing, each said section forming a flared reflective area such that light emitted by the illumination light source in the light housing is reflected by the reflective areas of the front section and the rear section of the reflector and hence directed both forward and backward, so as for the illumination device to provide wide-range lighting.

2. An illumination device for providing synchronous forward and backward lighting, comprising:

a housing composed of an inner housing member and an outer housing member, wherein the inner housing member is formed of a light-permeable material and has a front end extended with an externally threaded section, there being an O-ring mounted around the externally threaded section, and the outer housing member is peripherally provided with at least a hollow area;

a main body having a front end provided with an illumination light source and a rear end provided with a pushbutton portion, the main body being configured for receiving a battery pack therein;

a reflector connected to the front end of the main body and having a front section and a rear section, wherein each said section forms a flared reflective area; and a cap fitted therein with a transparent cover;

wherein the illumination device is assembled by: inserting the main body, whose said front end is connected with the reflector, into the inner housing member; connecting the inner housing member to the outer housing member; and screwing the cap onto the externally threaded section extending from the front end of the inner housing member; and wherein once the illumination device is powered on, light emitted by the illumination light source at the front end of the main body is reflected by the reflective areas of the front section and the rear section of the reflector and hence directed both forward and backward, the forward directed light passing through the cap at a front end of the illumination device, the backward directed light passing through the light-permeable inner housing member and the at least a hollow area peripherally provided on the outer housing member, so as for the illumination device to provide synchronous forward and lateral lighting, the lateral lighting serving esthetic purposes or as an alert in cases where it is too dark for a user using the illumination device to be seen by others.

3. The illumination device of claim 2, wherein the inner housing member has an outer periphery formed with at least a groove, and the outer housing member is formed with at least a pair of spaced apart ribs corresponding in position to and configured to be fitted tightly into the at least a groove so that the inner housing member and the outer housing member are limited in position relative to each other.

4. The illumination device of claim 2, wherein the inner housing member has a rear end formed with at least a recess, and the outer housing member is protrudingly provided with at least an engaging portion corresponding in position to and configured for engaging with the at least a recess so that the inner housing member and the outer housing member are limited in position relative to each other.

5. The illumination device of claim 2, wherein the reflector has a rear-end periphery extended with two hooks configured for respectively engaging with openings which are formed on the main body and correspond in position to the hooks, and a pressing portion is circumferentially provided adjacent to, on an inner side of, and spaced from each said hook of the reflector and configured for pressing against a peripheral portion of the main body, so as for the reflector and the main body to be limited in position relative to each other.

6. The illumination device of claim 2, wherein the inner housing member has a rear end formed with a hole through which the pushbutton portion at the rear end of the main body can extend during assembly.

* * * * *